US006444092B1

(12) United States Patent
Münchow

(10) Patent No.: US 6,444,092 B1
(45) Date of Patent: Sep. 3, 2002

(54) PROCESS OF RECYCLING FILLERS AND COATING PIGMENTS FROM THE PREPARATION OF PAPER, PAPERBOARD AND CARDBOARD

(75) Inventor: Dieter Münchow, Köln (DE)

(73) Assignee: Alpha Calcit Füllstoff GmbH, Cologne (DE)

( * ) Notice: Subject to any disclaimer, the term of this patent is extended or adjusted under 35 U.S.C. 154(b) by 0 days.

(21) Appl. No.: 09/741,023

(22) Filed: Dec. 21, 2000

Related U.S. Application Data

(60) Division of application No. 09/227,533, filed on Jan. 8, 1999, now Pat. No. 6,214,166, which is a continuation-in-part of application No. PCT/EP97/01375, filed on Mar. 19, 1997.

(30) Foreign Application Priority Data

Jul. 9, 1996 (DE) ..... 196 27 523.7

(51) Int. Cl.[7] ..... D21F 1/66

(52) U.S. Cl. ..... 162/189; 162/190; 162/DIG. 9; 210/928

(58) Field of Search ..... 106/405, 464; 162/4, 56, 55, 57, 189, 190, DIG. 9; 210/928

(56) References Cited

U.S. PATENT DOCUMENTS

| | | | | |
|---|---|---|---|---|
| 3,783,096 A | | 1/1974 | Perdue et al. | 162/181 A |
| 4,767,464 A | * | 8/1988 | Strauch et al. | 106/474 |
| 5,478,441 A | * | 12/1995 | Hamilton | 162/189 |
| 6,207,015 B1 | | 3/2001 | Templer et al. | 162/189 |

FOREIGN PATENT DOCUMENTS

| | | |
|---|---|---|
| DE | 4034054 | 4/1992 |
| EP | 0492121 | 7/1992 |
| EP | 0554285 | 8/1993 |
| EP | 0576177 | 12/1993 |
| EP | 0625611 | 11/1994 |
| EP | 0658606 | 6/1995 |
| WO | 01621 | 1/1998 |

OTHER PUBLICATIONS

Gallardo, J., et al., "Lime Sludge as a Mineral Filler in Paper," *Abstract Bulletin of the Institute of Paper Chemistry*, vol. 58, No. 10: 1294 (1988)

* cited by examiner

*Primary Examiner*—Dean T. Nguyen
(74) *Attorney, Agent, or Firm*—Brobeck Phleger & Harrison, LLP

(57) ABSTRACT

The present invention relates to a process for recycling fillers and coating pigments from the preparation of paper, paperboard and cardboard found in the residual water sludges from coating plant waste waters, deinking plants, internal water treatment plants or separators, and to the use of a thus obtained pigment slurry for the preparation of a coating compound for the paper industry or in the paper stock for papermaking. An essential element of the invention is a process for recycling fillers and coating pigments from the preparation of paper, paperboard and cardboard found in the residual water sludges from coating plant waste waters, deinking plants, internal water treatment plants or separators, characterized in that the residual water sludges containing the fillers and coating pigments are subjected to mixing and then milling together with fresh pigments or fresh fillers in the form of powders, fresh-pigment containing slurries and/or fresh-filler containing slurries to yield a pigment slurry.

8 Claims, No Drawings

PROCESS OF RECYCLING FILLERS AND COATING PIGMENTS FROM THE PREPARATION OF PAPER, PAPERBOARD AND CARDBOARD

CROSS REFERENCE TO RELATED APPLICATION

This application is a divisional application of U.S. application Ser. No. 09/227,533, filed Jan. 8, 1999 now U.S. Pat. No. 6,214,166, which is a continuation-in-part of International Application PCT/EP97/01375, filed Mar. 19, 1997, designating the U.S., the text of which is incorporated herein by reference in its entirety.

TECHNICAL FIELD

The present invention relates to a process for recycling fillers and coating pigments from the preparation of paper, paperboard and cardboard found in the residual water sludges from coating plant waste waters, deinking plants, internal water treatment plants or separators, and to the use of thus obtained pigment slurries as fillers for the preparation of paper or as a pigment slurry for the preparation of a coating compound for the paper industry.

In the preparation of paper, the raw material, i.e. wood pulp, wood, fine straw pulp or rag pulp, is admixed with paper pulp, fillers and pigments in order to achieve a closed surface and thus to improve the properties of the paper, especially the whiteness, opacity and printability.

Almost all papers are admixed with fillers which confer a uniform look-through, improved softness, whiteness and touch especially to printing and writing papers. These fillers, mostly called "ashes" since they remain as ashes in the combustion analysis, are either added to the fiber suspension or applied in the coating step.

Uncoated papers contain up to 35% by weight of fillers, coated papers contain from 25 to 50% by weight thereof. The amount of fillers employed is highly dependent on the intended use of the paper. Highly filled papers have a lower strength and poorer sizing properties.

The filler content in the paper stock is usually between 5 and 35% by weight and consists of primary pigments or recycled coating pigments which may be derived from coating residuals or from coated rejects. In addition to the whiteness of the filler which is important for whitened papers, the grain size plays an important role since it has a strong influence on the filler efficiency and the physical properties of the paper, in particular porosity. The proportion of filler remaining in the paper is between 20 and 80% of the amount added to the fiber suspension. The efficiency depends on the nature of the filler and on the composition of material, the degree of beating, the fixing of the filler particles by resin and aluminum sulfate, the basis weight, the paper machine speed, the method of water removal and the mesh of the wire.

As judged by their consumption, the following products have rather great importance today as fillers and coating pigments: china clay, calcium carbonate, artificial aluminum silicates and oxide hydrates (alumina trihydrate), titanium dioxide, satin white, talcum and calcium silicate.

In the recycling of waste paper, the fillers and pigments are obtained as a waste product, especially in deinking plants. Such a waste product consists of, for example, 50% by weight of cellulose, 25% by weight of china clay, and 20% by weight of calcium carbonate; however, further small contents of calcium sulfate, titanium dioxide, talcum or other solids may also be present, and those mixtures may have a varying fiber content.

In EP 0 492 121 B1, the processing of waste paper as performed to date is described as involving the separation of these waste products from the process as a mixture of waste water and solids to yield a pure waste product which contains about 50% of solids and is disposed of in dumps. It is proposed to intimately mix the sludge-like mass of water and solids, and then to comminute this mixture of water and solids coarsely, finely or extremely finely, and only then to use it further with the addition of corresponding aggregates. The use of this material as a starting material for dyes, adhesives, fillers and hydraulic binders is suggested.

DE 40 34 054 C1 proposes a process for the recovery of raw materials from the mechanical residual water sludge of the paper industry. In this process, after the coarse junk has been separated off, the residual waste water sludge is first freed of its black particle content by centrifuging, and thereafter separated into fibers, fillers, pigments and agglomerates by fractional screening. The agglomerates are subjected to shearing and discarded while the fibers, fillers and pigments are selectively directed to reuse, optionally after further treatment.

From EP 0 576 177 A1, a process is known for the recycling and reuse of raw materials from the residual water sludges of the paper industry, characterized in that in a first process step, the sludge suspension is subjected to a first screening/purification process while it is relatively low-viscous, then concentrated, heated and passed through a dispersing apparatus, after which the resulting sludge is reused in paper production.

EP 0 554 285 B1 reports that all recovery processes are directed to the separation of materials from cycles which are per se less contaminated since the recycling of the so-called stuff or slush pulp, which consists of fibers and fillers, to the papermaking process is out of the question because of its higher dirt content. Accordingly, a process is described for recovering the usable fibers and fillers contained in the residual waste water sludge from the mechanical water treatment plant.

SUMMARY OF THE INVENTION

This process is characterized by adjusting a defined solids content, separating the coarse junk contents, separating the black particle contents, fractional fine-screening of the usable contents, and recycling the fiber contents and the filler and pigment contents to the raw material processing of the paper factory.

In the residual water sludges from coating plant waste waters; deinking plants, internal water treatment plants or separators, the fillers and coating pigments are often present in an agglomerated form and with low whiteness which limits the possibility of direct reuse in raw material processing, especially in the coat.

It has been the object of the invention to provide a process for recycling raw materials for papermaking, especially the fillers and coating pigments, while energy costs and cost of raw materials as well as shipping costs are saved.

According to the invention, the above object is achieved by a process for recycling fillers and coating pigments from the preparation of paper, paperboard and cardboard found in the residual water sludges from coating plant waste waters, deinking plants, internal water treatment plants or separators, characterized in that the residual water sludges containing the fillers and coating pigments are subjected to mixing and then milling together with fresh pigments or fresh fillers in the form of powders, fresh-pigment containing slurries and/or fresh-filler containing slurries to yield a pigment slurry.

By means of the above described process according to the present invention, a defined concentrated pigment slurry or filler slurry is obtained which can be employed in the preparation of paper, paperboard and cardboard.

In papermaking, it is usual to employ the fillers and coating pigments either as powders or in the form of concentrated slurries with a solids content of from 50 to 80% by weight. Those fillers and pigments are usually supplied by the manufacturers with the desired whiteness and grain size distribution. Now, the core of the present invention resides in supplying the pigment in a kind of "basic grade", preferably as a solid or as a highly concentrated slurry, with a solids content of, for example, from 70% by weight to 85% by weight or more, and an average grain diameter of, for example, 50% less than 2 $\mu$m to 10 $\mu$m, especially 2 $\mu$m to 5 $\mu$m, and milling in an aqueous phase in situ in a satellite milling plant to obtain the desired whiteness and grain size. Thus, the above mentioned residual water sludges are not added to the ready-supplied or ready-prepared raw materials, but they are first given the desired whiteness and fineness by mixing and then milling together with fresh pigments or fresh fillers in the form of powders, fresh-pigment containing slurries and/or fresh-filler containing slurries, and then used as a filler or coating pigment. The mineral fillers and pigments mentioned are usually milled to give the desired grain size in a wet or dry milling method. In wet milling, a large amount of water is inherently required. According to the invention, it has now been found that part or all of the water necessary for the mixing and then milling of the fresh pigments or fresh fillers in the form of powders, fresh-pigment containing slurries and/or fresh-filler containing slurries can be replaced by the residual water sludges which may contain fibers. Agglomerates of the fillers or pigments usually present in the residual water sludges do not interfere since they are comminuted to the desired grain sizes in the course of the wet milling process. Other advantages of the present invention are a greater flexibility of the desired grain sizes obtainable in situ, lower shipping costs because no water is shipped as would be necessary in the usual slurry, and an improved stability of the self-prepared pigment slurry, as compared to the prior art.

In the processing of residual water sludges, it is of course required to separate and discard the coarse dirt contents consisting of splinters, sand grains and other impurities. The screenings thus obtained consist of fibers, fillers, pigments, fine sand, black particles and agglomerates of fillers and pigments, or pigments, fibers and fillers. "Filler" usually means the fine particles employed in the paper stock; "pigment" means the fine particles employed in the coat. The black particles which are not usable as a rule exhibit a great variability of grain sizes. They mainly consist of grey to black colored sand, soil rubbings, machine rubbings, carbonized lubricants, acid-attacked organic particles, rust and agglomerated dust or mixtures thereof. Separation of those black particles by centrifuging or flotation is usually required if the waste water sludges are to be directed to the raw material processing. According to the invention, however, such a separation of black particles is not necessarily required since these particles are usually comminuted in the milling of the fresh fillers and fresh pigments to such an extent that the whiteness is less affected by the black particles.

Nevertheless, of course, a separation of black particles, especially by centrifuging, as described, for instance, in EP 0 554 285 B1, is also possible according to the invention in order to obtain particularly high qualities of the fillers or pigments according to the invention.

Similarly, it may be convenient to perform fiber separation processes, especially in the processing of residual water sludges from deinking plants, water treatment plants and separators. Known methods which suggest themselves are flocculation and sedimentation, filtering, screening, centrifuging and other, chemical treatment methods, such as oxidation. In this case, a mixture of different pigments is usually present which often contains china clay, calcium carbonate and talcum. Agglomerates frequently form during the separation processes due to flocculation and charge reversal. Accordingly, those residual water sludges which have a low solids content can hardly be properly employed as raw materials.

Therefore, for the preparation of coats, it is required to increase the solids content of the pigment mixture and usually to enhance the whiteness by per se known methods. The disruption of agglomerates which adversely affect the flowing properties of a coat at the blade by forming doctor streaks and adversely affect the properties of the resulting coat is particularly preferred. The pigment and filler particles of the residual water sludge which are designated for use as fillers or pigments act as milling aids and dispersing aids to disrupt the agglomerates in the milling process. At the same time, the residual water sludge including the loaded particle acts as a dispersing aid and milling aid for the fillers and pigments in the milling process so that the otherwise usual amounts of dispersing aids and milling aids can be reduced according to the invention.

Accordingly, it is particularly preferred according to the invention to adjust the residual water sludge to a solids concentration of from 0.02% by weight to 50% by weight, especially from 1% by weight to 30% by weight, for said mixing and then milling together with fresh pigments or fresh fillers in the form of powders, fresh-pigment containing slurries and/or fresh-filler containing slurries. When the concentration is too low, the recycling process becomes uneconomical.

The ratio of fillers and/or pigments to fibers in the residual water sludges may vary widely. It is particularly preferred according to the present invention to use residual water sludges with an optionally increased concentration of fillers and/or pigments which is in the range of from 2% by weight to 80% by weight, especially from 20% by weight to 60% by weight, based on the solids content. Thus, both the fiber content and the content of fillers and/or pigments may vary, for example, from 2 to 98% by weight, or from 98 to 2% by weight. Of course, residual water sludges free of fibers can also be employed according to the invention.

By way of example, the preferred compositions of various waste water sludges are set forth below. Preferably, the waste water from the production comprises from 0.5 to 5% by weight, especially 2.5% by weight, of lost substances at a special fresh water requirement of from 10 to 100 l/kg, especially 20 l/kg. The solids content is preferably from 0.02 to 0.5, especially 0.125% by weight. Particularly preferred according to the invention is a ratio of fiber content to filler and/or pigment content of 20%:80% by weight or 80%:20% by weight, especially a ratio of fibers to pigments of 40%:60% by weight in a waste water from the production.

The pH value of the residual water sludges obtained as waste waters from the production may vary widely. It is particularly preferred to adjust the pH value within a range of from 4.5 to 8.5, especially in the neutral range around pH 7.

Waste water from the coating plant which can be used according to the invention may have a solids content of, for example, from 0.1 to 20% by weight, especially 1% by weight, prior to precipitation, and from 1 to 30% by weight, especially around 5% by weight, after precipitation. The pH value may be in the range of, for example, from 6.5 to 10, preferably 7.5, prior to precipitation, and from 6.0 to 10.0, preferably 7.0, after precipitation. The ashes content should be, in particular, in the range of from 60 to 95% by weight, especially around 90% by weight. A typical composition contains from 1 to 90% by weight, especially 20% by weight, of china clay, from 1 to 90% by weight, especially 60% by weight, of calcium carbonate, from 0.5 to 50% by weight, especially 15% by weight, of talcum, and from 0.1 to 40% by weight, especially 5% by weight, of other materials.

According to the present invention, china clay, natural or precipitated calcium carbonates, artificial or natural aluminum silicates and oxide hydrates, titanium dioxide, satin white, dolomite, mica, metal flakes, especially aluminum flakes; bentonite, rutile, magnesium hydroxide, gypsum, sheet silicates, talcum, calcium silicate and other rocks and earths are preferably used as the fresh pigment and/or fresh filler.

The fresh pigment or fresh filler is preferably mixed and milled as a powder, fresh-pigment containing and/or fresh-filler containing slurry in the presence of the residual water sludges and optionally usual milling aids and/or dispersing aids to give a slurry with a solids content of from 30 to 85% by weight, especially from 40 to 75% by weight.

The fresh pigments or fresh fillers present as powders, fresh-pigment containing and/or fresh-filler containing slurries are preferably milled to a grain size distribution of from 10 to 99% by weight of particles <1 $\mu$m, especially from 10 to 95% by weight of particles <1 $\mu$m, respectively based on the equivalent diameter.

From EP 0 625 611 A1, grain size distributions for coating pigments are known which are also preferably obtained according to the present invention. Thus, it is particularly preferred according to the present invention for the pigments to have the following grain size distribution:

a) from 95 to 100% by weight of particles <10 $\mu$m;
b) from 50 to 100% by weight of particles <2 $\mu$m, especially from 50 to 95% by weight of particles <2 $\mu$m;
c) from 27 to 95% by weight of particles <1 $\mu$m, especially from 27 to 75% by weight of particles <1 $\mu$m; and
d) from 0.1 to 55% by weight of particles <0.2 $\mu$m, especially from 0.1 to 35% by weight of particles <0.2 $\mu$m; respectively based on the equivalent diameter of the particles.

According to the invention, a broad variation of the whiteness and grain size distributions is possible in addition which can be controlled, in particular, by the manner and duration of milling. Thus, it is possible to mix a relatively coarse fresh filler in situ with a large amount of residual water sludge to obtain a slurry which is incorporated in the paper stock after milling. In the same way, it is possible to use a smaller amount of residual water sludge and to perform a finer milling with fresh pigment in situ which is then used as a coating pigment and/or filler. Thus, papermakers are no longer bound to predetermined particle sizes of the fresh pigments and/or fresh fillers and pigment slurries obtainable from suppliers of raw materials. The pigment slurries obtainable from suppliers of raw materials are usually characterized by the weight percent of particles smaller than 2 $\mu$m, for example, as type 95, 90, 75, 60, 50 etc. Thus, papermakers are capable of preparing themselves pigment slurries in a satellite plant in situ according to the current needs. This permits a flexible and quick reaction to changing quality and production requirements, for example, with respect to the different papermaking raw materials for the paper stock, the pigments or slurries for precoating, top coating and single coating or pigmentation alone, and the mixing with other pigments. Above all, this evidently means a considerable reduction of shipping costs, since ready slurries with high water contents need not necessarily be shipped over great distances.

Any mill capable of producing adequate particle-size reduction may be used in the process of this invention. Selection of a suitable mill is a routine matter for the skilled artisan. Examples of suitable mills include roller mills, hammer mills, cage mills, and chain mills. In one mode, a ball mill, preferably an agitated ball mill, is used. In accordance with the present invention, dispersers or homogenizers may also be used for mixing and for further size reduction of pre-milled particles.

Even though per se known wetting agents, stabilizers, milling aids and dispersing aids may be employed according to the invention during the mixing and milling of the fresh pigments or fresh fillers in the form of powders, fresh-pigment containing slurries and/or fresh-filler containing slurries together with the residual water sludges, as known, for example, from EP 0 625 611 A1, the quantity thereof required is clearly reduced according to the invention as compared to the prior art. On one hand, the residual water sludges already contain a certain amount of the mentioned agents. On the other hand, it is not necessary to employ the wetting agents, stabilizers, milling and dispersing aids in the usual quantities because direct milling in situ is possible and thus the period of time elapsing between the preparation of the slurries and their use can be significantly shortened. Another advantage of the smaller amounts of auxiliaries employed is the improved retention of the pigments in papermaking since larger amounts have a detrimental effect on retention.

The process according to the invention is particularly suitable for the processing of waste water sludges or fiber suspension substreams, consisting of fillers and fibers, from the waste paper processing paper industry or the recycling of paper rejects, especially in the processing of waste paper from the ash removal step where great importance is attached to a type-specific and grain-size specific separation of the fillers and pigments, to utilize them by recycling and thus to benefit from the energy and value invested.

The coating pigment slurries obtainable according to the present invention may be employed to particular advantage in the paper industry, especially for the preparation of a coat for paper coating or in the paper stock. Particularly preferred is their use for the preparation of a coating pigment slurry for offset paper. In addition, the slurries according to the invention are also suitable for the preparation of a coating compound for light-weight coated papers, especially with high coating speeds, and for the preparation of rotary offset papers, especially for the preparation of light-weight coated rotary offset papers, the coating of cardboard and special papers, such as labels, wallpapers, silicone base paper, self-copying paper, and for admixture with intaglio printing paper. Thus, the coating pigment slurries obtainable according to the invention may be employed, in particular, in sheet-fed offset papers, especially for sheet-fed offset single coating, sheet-fed offset double coating: sheet-fed offset precoating and sheet-fed offset top coating; in rotary offset papers, especially for LWC rotary offset single coating, rotary offset double coating: rotary offset precoating and rotary offset top coating; in intaglio printing papers, especially for LWC intaglio single coating, intaglio double coating: intaglio precoating and intaglio top coating; in cardboard making, especially for cardboard double coating: cardboard precoating and cardboard top coating; and for special papers, especially for labels and flexible packings.

The process offers the opportunity to employ the pigment slurries prepared according to the invention without a loss in quality in the base papers, coatings and especially final qualities prepared therewith.

In the following, some coating formulations which can be obtained according to the present invention are given for illustrative purposes (all figures converted to weight parts of solids (atro/active ingredient)).

1. Sheet-fed Offset Paper 1.1 Sheet-fed Offset Single Coating 70 parts by weight of commercially available $CaCO_3$ (type 90)

30 parts by weight of commercially available clay (fine, e.g., U.S. No. 1)

11 parts by weight of commercially available latex (acrylate)

0.6 parts by weight of commercially available carboxymethylcellulose (CMC)

0.8 parts by weight of commercially available hardener (urea-formaldehyde, melamine-formaldehyde, epoxy resin)

0.5 parts by weight of commercially available brightener (opt.)

0.5 parts by weight of commercially available Ca stearate

| | |
|---|---|
| solids content: | 64% |
| Brookfield viscosity (100/min): | 1,200 mPa |
| pH value: | 8.5 |

1.2 Sheet-fed Offset Double Coating 1.2.1 Sheet-fed Offset Precoating 100 parts by weight of commercially available $CaCO_3$ (type 60 or 75)

10 parts by weight of commercially available latex 4 parts by weight of commercially available starch (native, oxidized, corn or potato starch)

0.8 parts by weight of commercially available hardener (urea-formaldehyde, melamine-formaldehyde, epoxy resin)

0.5 parts by weight of commercially available brightener (opt.)

| | |
|---|---|
| solids content: | 66% |
| Brookfield viscosity (100/min): | 1,100 mPa |
| pH value: | 9.0 |

1.2.2 Sheet-fed Offset Top Coating 70 parts by weight of commercially available $CaCO_3$ (type 90)

30 parts by weight of commercially available clay (fine, e.g., U.S. No. 1)

10 parts by weight of commercially available latex (acrylate)

0.6 parts by weight of commercially available CMC 0.8 parts by weight of commercially available hardener (urea-formaldehyde, melamine-formaldehyde, epoxy resin)

0.5 parts by weight of commercially available brightener (opt.)

0.7 parts by weight of commercially available Ca stearate

| | |
|---|---|
| solids content: | 64% |
| Brookfield viscosity (100/min): | 1,200 mPa |
| pH value: | 8.5 |

2. Rotary Offset Paper 2.1 LWC Rotary Offset Single Coating 50 parts by weight of commercially available $CaCO_3$ (type 90)

50 parts by weight of commercially available clay (fine, Engl. clay)

2 parts by weight of commercially available starch (native, oxidized, corn or potato starch)

12 parts by weight of commercially available latex (XSB)

0.8 parts by weight of commercially available hardener (urea-formaldehyde, melamine-formaldehyde, epoxy resin)

0.7 parts by weight of commercially available brightener (opt.)

0.5 parts by weight of commercially available Ca stearate

| | |
|---|---|
| solids content: | 62% |
| Brookfield viscosity (100/min): | 1,400 mPa |
| pH value: | 8.5 |

2.2 Rotary Offset Double Coating 2.2.1 Rotary Offset Precoating 100 parts by weight of commercially available $CaCO_3$ (type 60 or 75)

4 parts by weight of commercially available starch (native, oxidized, corn or potato starch)

12 parts by weight of commercially available latex (XSB)

0.8 parts by weight of commercially available hardener (urea-formaldehyde, melamine-formaldehyde, epoxy resin)

0.5 parts by weight of commercially available brightener (opt.)

| | |
|---|---|
| solids content: | 66% |
| Brookfield viscosity (100/min): | 1,200 mPa |
| pH value: | 9.0 |

2.2.2 Rotary Offset Top Coating 60 parts by weight of commercially available $CaCO_3$ (type 95)

40 parts by weight of commercially available clay (fine, Engl. clay)

10 parts by weight of commercially available latex (XSB)

0.6 parts by weight of commercially available CMC 0.8 parts by weight of commercially available hardener (urea-formaldehyde, melamine-formaldehyde, epoxy resin)

0.5 parts by weight of commercially available brightener (opt.)

0.5 parts by weight of commercially available Ca stearate

| | |
|---|---|
| solids content: | 64% |
| Brookfield viscosity (100/min): | 1,200 mPa |
| pH value: | 8.5 |

3. Intaglio Printing Paper 3.1 LWC Intaglio Single Coating 70 parts by weight of commercially available clay (normal, Engl. clay)

30 parts by weight of commercially available talcum 5.0 parts by weight of commercially available latex (acrylate sole binder)

0.2 parts by weight of commercially available thickener (synthetic)

1.0 parts by weight of commercially available Ca stearate

| | |
|---|---|
| solids content: | 58% |
| Brookfield viscosity (100/min): | 1,200 mPa |
| pH value: | 8.5 |

3.2 Intaglio Double Coating 3.2.1 Intaglio Precoating 100 parts by weight of commercially available $CaCO_3$ (type 75)

6.0 parts by weight of commercially available latex (acrylate sole binder)

0.3 parts by weight of commercially available thickener (synthetic)

0.5 parts by weight of commercially available Ca stearate

| | |
|---|---|
| solids content: | 66% |
| Brookfield viscosity (100/min): | 1,200 mPa |
| pH value: | 9.0 |

3.2.2 Intaglio Top Coating 85 parts by weight of commercially available clay (Engl. clay)

15 parts by weight of commercially available clay (calcined clay)

5.0 parts by weight of commercially available latex (acrylate sole binder)

0.2 parts by weight of commercially available thickener (synthetic)

0.8 parts by weight of commercially available Ca stearate

| | |
|---|---|
| solids content: | 57% |
| Brookfield viscosity (100/min): | 1,300 mPa |
| pH value: | 8.5 |

4. Cardboard 4.1 Cardboard Double Coating 4.1.1 Cardboard Precoating 100 parts by weight of commercially available $CaCO_3$ (type 75)

3 parts by weight of commercially available starch (native, oxidized, corn or potato starch)

14 parts by weight of commercially available latex (XSB)

0.8 parts by weight of commercially available hardener (urea-formaldehyde, melamine-formaldehyde, epoxy resin)

0.5 parts by weight of commercially available brightener (opt.)

| | |
|---|---|
| solids content: | 66% |
| Brookfield viscosity (100/min): | 1,000 mPa |
| pH value: | 9.0 |

4.1.2 Cardboard Top Coating 50 parts by weight of commercially available $CaCO_3$ (type 90)

50 parts by weight of commercially available clay (fine/Engl. clay)

13 parts by weight of commercially available latex (acrylate)

2 parts by weight of commercially available co-binder (acrylate)

0.8 parts by weight of commercially available hardener (urea-formaldehyde, melamine-formaldehyde, epoxy resin)

0.6 parts by weight of commercially available Ca stearate

| | |
|---|---|
| solids content: | 60% |
| Brookfield viscosity (100/min): | 1,200 mPa |
| pH value: | 8.5 |

5. Special Papers 5.1. Labels 70 parts by weight of commercially available clay (normal/Engl. clay)

10 parts by weight of commercially available $TiO_2$ (rutile)

20 parts by weight of commercially available $CaCO_3$ (type 90)

16 parts by weight of commercially available latex (XSB)

0.5 parts by weight of commercially available hardener (EH) (urea-formaldehyde, melamine-formaldehyde, epoxy resin)

0.6 parts by weight of commercially available Ca stearate

| | |
|---|---|
| solids content: | 60% |
| Brookfield viscosity (100/min): | 1,200 mPa |
| pH value: | 8.5 |

5.2 Flexible Packing 80 parts by weight of commercially available clay (normal, Engl. clay)

20 parts by weight of commercially available $CaCO_3$ (type 90)

14 parts by weight of commercially available latex (acrylate)

0.8 parts by weight of commercially available CMC 0.5 parts by weight of commercially available hardener (urea-formaldehyde, melamine-formaldehyde, epoxy resin)

0.6 parts by weight of commercially available brightener (opt.)

1.0 parts by weight of commercially available Ca stearate

| | |
|---|---|
| solids content: | 58% |
| Brookfield viscosity (100/min): | 1,200 mPa |
| pH value: | 8.5 |

The operation of the process according to the invention in a usual paper factory may be described as follows:

Silos of any size desired, for example, from 50 to 1000 $m^3$, serve to contain and store dry fillers and pigments having a uniform or optionally different basic grain size distribution; for example, calcium carbonate. Dosing devices ensure the discharging of the filler and/or pigment powder, followed by conveying, optionally to daily service tanks, optionally having purification devices. Dosing devices for the powder or powders, optionally controlled by stored-program controls (SPC) with the electronically integrated formulations, determine by gravimetry and/or volumetry the required amounts of the components to be mixed with water, fresh water or white water from the paper factory. According to the invention, a residual water sludge with a solids content of, in particular, from 0.02 to 50% by weight is employed to replace part or all of the fresh water or white water, optionally with the addition of water when the concentration of the residual water sludge is high. Accordingly, there are further required containers for storing the residual water sludge, dosing devices for the residual water sludge which determine the amount to be employed by gravimetry or volumetry. In addition, there are required containers for receiving the mixture of fresh pigment or fresh filler in the form of a powder, fresh-pigment containing and/or fresh-filler containing slurry and residual water sludge/water, optionally milling aids and dispersing aids or other auxiliaries. For dispersing and stability adjustment, dispersing means (dissolvers) or other agitators are required.

The milling of the fresh pigments and/or fresh fillers in the form of powders, fresh-pigment containing and/or fresh-filler containing slurries with the residual water sludges can be performed continuously according to the invention in usual agitator ball mills, for example, having a content of from 700 to 5000 l or more. Milling media, preferably milling balls, especially having a diameter of from 1 to 4 mm, are used.

Screens, preferably sieve bends, for separating impurities (ball crushings, separating materials, rust etc.) are usually used for the processing of the residual water sludges. Laser measuring instruments serve to determine and control the milling fineness during the milling process and for the computer-based control of the agitator ball mill plant. Other dosing-injecting means for afterdosing dispersing and milling aids to the agitator ball mill may also be required. After the discharge of the pigment slurry, screens for again separating off pollutants with a size of more than 20 $\mu$m may be required. Typically, the fresh pigment and/or filler material employed, especially calcium carbonate powder, has a whiteness in dry form according to DIN 53163 of more than 90%, especially a whiteness of more than 95% with a fineness of $d_{97} \leqq 25$ $\mu$m, a fineness of not larger than $d_{97} \leqq 100$ $\mu$m, a carbonate purity of $\geqq 98\%$, an $SiO_2$ content of $\leqq 1.0\%$, especially $\leqq 0.2\%$.

Varying amounts of, for example, carbonate, mixed with residual water sludge, are milled into a slurry having a solids content which may be adjusted, for example, to that of a ready-to-use coat. Optionally, the solids content may also be adjusted to a higher value if the pigment slurry is to be temporarily stored for an extended period of time. The fineness of the slurry is mainly determined by the dwelling time and/or the energy uptake during the production in the agitator ball mill.

The whiteness of the pigment slurry depends, inter alia, on the mixing ratio of fresh pigment to residual water sludge, and especially on the type of fresh pigment employed.

One embodiment of the composition of the residual water sludges which can be employed according to the invention is stated in the following Table 1:

TABLE 1

| | | |
|---|---|---|
| MgO | % | 2.15 |
| $Al_2O_3$ | % | 24.38 |
| $SiO_2$ | % | 29.84 |
| $P2O_5$ | % | 0.81 |
| CaO | % | 27.26 |
| $TiO_2$ | % | 0.20 |
| $V_2O_5$ | % | <0.01 |
| $Cr_2O_3$ | % | 0.01 |
| MnO | % | 0.01 |
| $Na_2O$ | % | 0.029 |
| $K_2O$ | % | 0.82 |
| $Fe_2O_3$ | % | 0.54 |
| $SO_4$ | % | 0.14 |
| Cl | % | 0.01 |
| NiO | % | <0.01 |
| CuO | % | 0.02 |
| ZnO | % | 0.01 |
| $Ga_2O_3$ | % | 0.01 |
| SrO | % | 0.02 |
| $ZrO_2$ | % | 0.01 |
| PbO | % | 0.02 |
| BaO | % | 0.06 |
| ignition loss | % | 13.40 |
| total | % | 100.00 |

A waste water sludge with the composition set forth in Table 1 was dried, and its fineness and color value were measured.

The values found were:

Fineness: (Cilas 850)

$D_{50}$ value=15.0 $\mu$m $D_{3.2}$ value=1.0 $\mu$m

Whiteness: (brightness $R_y$, C/2° DIN 53163)

$R_y$ value =84.1 yellowness index: (C/2°)=−5.6

The water content of the waste water sludge was 19.5%. The pH value was measured in a 10% solution and found to be 6.8. Part of the dried waste water sludge was heated at 450° C. for 2 hours. The ignition loss (organic contents) was 13.4%.

Subsequently, on a laboratory scale, the waste water sludge, 40% by weight, was slurried with 60% by weight of fresh pigment Calcicell®, a natural crystalline calcium carbonate (range of grain sizes 0–20 $\mu$m, $D_{50}$ value=5.5 $\mu$m, whiteness C/2° DIN 53163=95±1), and briefly milled in the mill.

Thereafter, the fineness and color value of the milled and dried product were measured.

The values found were:

Fineness: (Cilas 850)

$D_{50}$ value=9.2 $\mu$m $D_9$ value=1.0 $\mu$m

The whiteness (brightness $R_y$, C/2° DIN 53163) after milling was:

$R_y$ value=92.0 yellowness index: (C/2° )=−2.6

(All fineness characteristics mentioned were determined by storage sedimentation analysis with a Cilas 850 analyzer of Cilas, France. The dispersing of the samples in alcohol was effected by means of a high-speed mixer using ultrasound.)

What is claimed is:

1. In a method for the preparation of a coating compound for the paper industry, the improvement wherein the coating compound comprises a slurry produced by milling a mixture of residual water sludges containing recycling filters and coating pigments together with raw pigments or raw fillers in the form of powders, raw-pigment containing slurries, raw-filler containing slurries, or a combination thereof.

2. In a method for the preparation of usual coating compounds to replace part or all of the coating pigments, the improvement wherein the coating compounds comprise a slurry produced by milling a mixture of residual water sludges containing recycling fillers and coating pigments together with raw pigments or raw fillers in the form of powders, raw-pigment containing slurries, raw-filler containing slurries, or a combination thereof.

3. In a method for making paper stock for papermaking, the improvement comprising mixing paper pulp and a slurry produced by milling a mixture of residual water sludges containing recycling fillers and coating pigments together with raw pigments or raw fillers in the form of powders, raw-pigment containing slurries, raw-filler containing slurries, or a combination thereof, to yield the paper stock.

4. In a method for the preparation of a coating compound for a specific type of paper, wherein said paper type is selected from the group consisting of: sheet-fed offset papers, rotary offset papers, intaglio printing papers, cardboard and special papers; the improvement wherein the coating compound comprises a slurry produced by milling a mixture of residual water sludges containing recycling fillers and coating pigments together with raw pigments or raw fillers in the form of powders, raw-pigment containing slurries, raw-filler containing slurries, or a combination thereof.

5. In a method for the preparation of a coating compound for the paper industry, the improvement wherein the coating compound comprises a slurry produced by milling a mixture of unrefined residual water sludges containing recycling fillers and coating pigments together with raw pigments or raw fillers in the form of powders, raw-pigment containing slurries, raw-filler containing slurries, or a combination thereof.

6. In a method for the preparation of usual coating compounds to replace part or all of the coating pigments, the improvement wherein the coating compounds comprise a slurry produced by milling a mixture of unrefined residual water sludges containing recycling fillers and coating pigments together with raw pigments or raw fillers in the form of powders, raw-pigment containing slurries, raw-filler containing slurries, or a combination thereof.

7. In a method for making paper stock for papermaking, the improvement comprising mixing paper pulp and a slurry produced by milling a mixture of unrefined residual water sludges containing recycling fillers and coating pigments together with raw pigments or raw fillers in the form of powders, raw-pigment containing slurries, raw-filer containing slurries, or a combination thereof, to yield the paper stock.

8. In a method for the preparation of a coating compound for a specific type of paper, wherein said paper type is selected from the group consisting of: sheet-fed offset papers, rotary offset papers, intaglio printing papers, cardboard and special papers; the improvement wherein the coating compound comprises a slurry produced by milling a mixture of unrefined residual water sludges containing recycling fillers and coating pigments together with raw pigments or raw fillers in the form of powders, raw-pigment containing slurries, raw-filler containing slurries, or a combination thereof.

* * * * *

UNITED STATES PATENT AND TRADEMARK OFFICE

CERTIFICATE OF CORRECTION

PATENT NO. : 6,444,092 B1
DATED : September 3, 2002
INVENTOR(S) : Münchow

It is certified that error appears in the above-identified patent and that said Letters Patent is hereby corrected as shown below:

Column 13,
Line 10, after "recycling", change "filters" to -- fillers --.

Signed and Sealed this

Seventeenth Day of December, 2002

JAMES E. ROGAN
*Director of the United States Patent and Trademark Office*